US008950497B2

(12) United States Patent
Critsinelis et al.

(10) Patent No.: US 8,950,497 B2
(45) Date of Patent: Feb. 10, 2015

(54) ASSEMBLIES, SYSTEMS AND METHODS FOR INSTALLING MULTIPLE SUBSEA FUNCTIONAL LINES

(75) Inventors: Antonio Carlos Falcao Critsinelis, Kingwood, TX (US); Selvakumar Subramaniam, Tomball, TX (US); Leo George Caffrey, Katy, TX (US); David Jonathan Knight, Sugar Land, TX (US); Brian Robert Ferrier, Perth (AU)

(73) Assignee: Chevron U.S.A. Inc., San Ramon, CA (US)

( * ) Notice: Subject to any disclaimer, the term of this patent is extended or adjusted under 35 U.S.C. 154(b) by 368 days.

(21) Appl. No.: 13/453,736

(22) Filed: Apr. 23, 2012

(65) Prior Publication Data

US 2013/0277060 A1 Oct. 24, 2013

(51) Int. Cl.
*E21B 7/12* (2006.01)

(52) U.S. Cl.
USPC ..... 166/338; 166/345; 166/351

(58) Field of Classification Search
CPC ... E21B 17/02; E21B 33/038; E21B 33/0385; E21B 43/013
USPC ..... 166/338, 345, 351
See application file for complete search history.

(56) References Cited

U.S. PATENT DOCUMENTS

| | | | | |
|---|---|---|---|---|
| 4,403,658 | A * | 9/1983 | Watkins | 166/355 |
| 4,661,016 | A * | 4/1987 | Baugh et al. | 405/169 |
| 4,784,523 | A * | 11/1988 | Louis et al. | 405/169 |
| 5,114,117 | A * | 5/1992 | Appleford et al. | 251/149.9 |
| 6,142,708 | A * | 11/2000 | Tarlton et al. | 405/170 |
| 6,223,675 | B1 * | 5/2001 | Watt et al. | 114/312 |
| 7,699,103 | B2 * | 4/2010 | Den Boer et al. | 166/250.01 |
| 7,903,914 | B2 * | 3/2011 | Smith | 385/100 |
| 8,430,168 | B2 * | 4/2013 | Goodall et al. | 166/336 |
| 2005/0115248 | A1 * | 6/2005 | Koehler et al. | 62/53.1 |
| 2009/0120632 | A1 * | 5/2009 | Worman et al. | 166/65.1 |
| 2009/0284068 | A1 * | 11/2009 | Yu et al. | 299/1.9 |

OTHER PUBLICATIONS

Amin et al., Subsea Development from Pore to Process, Oilfield Review, Spring 2005, p. 4-17.

* cited by examiner

*Primary Examiner* — Matthew Buck
*Assistant Examiner* — Aaron Lembo
(74) *Attorney, Agent, or Firm* — Karen R. DiDomenicis

(57) ABSTRACT

Disclosed are methods for installing at least two subsea functional lines having differing functions, such as a subsea umbilical and a subsea flowline, and integrated termination assemblies for use in the methods. The integrated termination assemblies combine terminations of the at least two subsea functional lines, simplifying the layout of a subsea production field, reducing the number of connections necessary and simplifying the installation of subsea functional lines used in offshore hydrocarbon production.

17 Claims, 7 Drawing Sheets

ASSEMBLIES, SYSTEMS AND METHODS FOR INSTALLING MULTIPLE SUBSEA FUNCTIONAL LINES

FIELD

The present disclosure relates to systems and methods for installing multiple subsea functional lines and associated subsea structures, such as those used in the offshore production of oil and gas, and assemblies for use therein.

BACKGROUND

In conventional practice, different subsea functional lines used in offshore hydrocarbon production, such as subsea pipelines, umbilicals, power cables and other subsea service lines, are installed on the seabed in separate installation operations. These lines are usually terminated with their own dedicated termination structure. The termination assemblies associated with each of these lines are installed in the same operation. Some structures such as boosting pumps, manifolds and trees are stand alone structures which are installed independently and subsequently connected to the functional lines. For instance, a subsea production manifold is separately installed on the seabed, and tree jumpers and flying leads are later installed to connect the multiple subsea trees to the manifold. A Pipeline End Termination (PLET) is installed on the seabed with the pipeline, and the PLET is subsequently connected to the manifold by way of jumpers and flying leads. As another example, an Umbilical Termination Assembly (UTA), also referred to as a Subsea Umbilical Termination Assembly (SUTA), is conventionally installed with an umbilical on the seabed, and subsequently connections are made between the UTA and other subsea structures including the PLET. Another example include booster pumps, compressors and seafloor process equipment, e.g., separators, distribution equipment and the like, which are separately installed on the seabed, and jumpers, cables and flying leads are later installed to connect them to the other structures.

It would be desirable to simplify the installation of subsea functional lines, as well as the termination assemblies associated therewith, and simplify subsea structure layout and reduce the number of subsea interconnections used in offshore hydrocarbon production.

SUMMARY

In one aspect, an integrated termination assembly is provided which includes a rigid support structure and at least a first functional line and a second functional line terminating at the rigid support structure and having a different function than the first functional line. The first and second functional lines can be production flow lines, umbilicals, electrical cables, hydraulic fluid lines, chemical injection lines, fiber-optic cables, gas injection lines, water injection lines, pneumatic lines, or combinations thereof.

A method for installing at least one first subsea functional line and at least one second subsea functional line using the integrated termination assembly is also provided, in which the integrated termination assembly is lowered from a surface vessel to a predetermined seabed location.

DESCRIPTION OF THE DRAWINGS

These and other objects, features and advantages of the present invention will become better understood with regard to the following description, appended claims and accompanying drawings where:

DETAILED DESCRIPTION

Figure 1A:
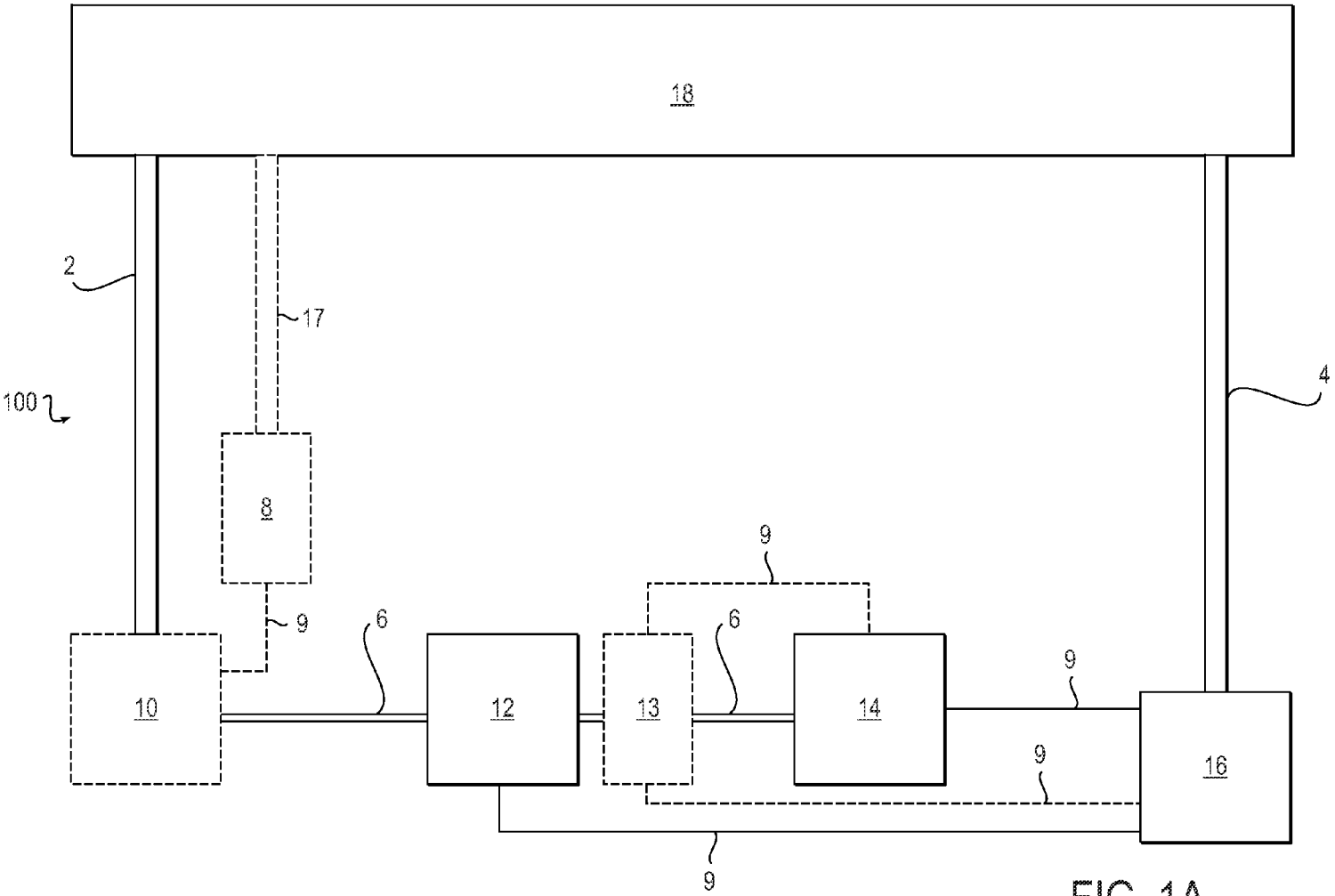
FIG. 1A (Prior Art)
FIG. 1A is a schematic diagram illustrating a conventional subsea installation according to the prior art.

FIG. 1A is a schematic diagram illustrating a conventional offshore hydrocarbon producing facility 100 including selected subsea facilities. At least one tree 14 is positioned on the seabed at a producing hydrocarbon well and connected to a Pipeline End Termination (PLET) 12 by way of a jumper 6, so that the fluids produced by the well are carried by the jumper to the PLET 12. If multiple trees 14 feed into the PLET 12, jumpers 6 will be used to convey the produced fluids to a pipeline manifold 13. A flowline 2, also referred to interchangeably herein as a pipeline, can terminate at one end at the PLET 12, and at the other end at a host facility 18. The host facility 18 can be any surface production facility, including an off shore platform, a floating production facility, a semi-floating production facility or a floating production vessel. The tree 14 (and optionally the manifold 13) is also connected to an umbilical termination assembly (UTA) 16 by way of a flying lead 9. An umbilical 4 can terminate at one end of the UTA 16, and at the other end at the host facility 18. The UTA 16 can also be connected to the PLET 12 by way of a flying lead 9. An optional pump 10 may be used to deliver hydrocarbons produced from the tree 14 to flowline 2, which delivers hydrocarbons to the host facility 18. The optional pump 10 can be connected to the host facility 18 by way of a power cable, also referred to as a power umbilical, 17. When pump 10 is present, electrical control equipment such as subsea switchgear or a subsea transformer 8 may also be used, which in turn is connected to pump 10 by way of a flying lead 9.

The components of the facility 100 shown in FIG. 1A are generally each separately installed in their desired permanent locations using conventional installation methods. To install functional lines for use in an offshore hydrocarbon producing facility, such as a flowline 2, an umbilical 4 or another functional line with their respective termination structures, separate termination structures or manifolds 13 are also installed on the seabed at the desired locations, and connections are subsequently made.

The present disclosure provides alternative methods for installing such components, particularly improved methods for installing differing functional lines and associated subsea structures and interconnections. The methods utilize an integrated termination assembly to enable cost-effective installation of differing functional lines. The functional lines to be installed can include at least two types of functional lines. For instance, suitable functional lines include, but are not limited to, production flowlines, umbilicals, electrical cables, hydraulic fluid lines, chemical injection lines, fiber-optic cables, gas injection lines, water injection lines, pneumatic lines, and combinations thereof.

Figure 1B:
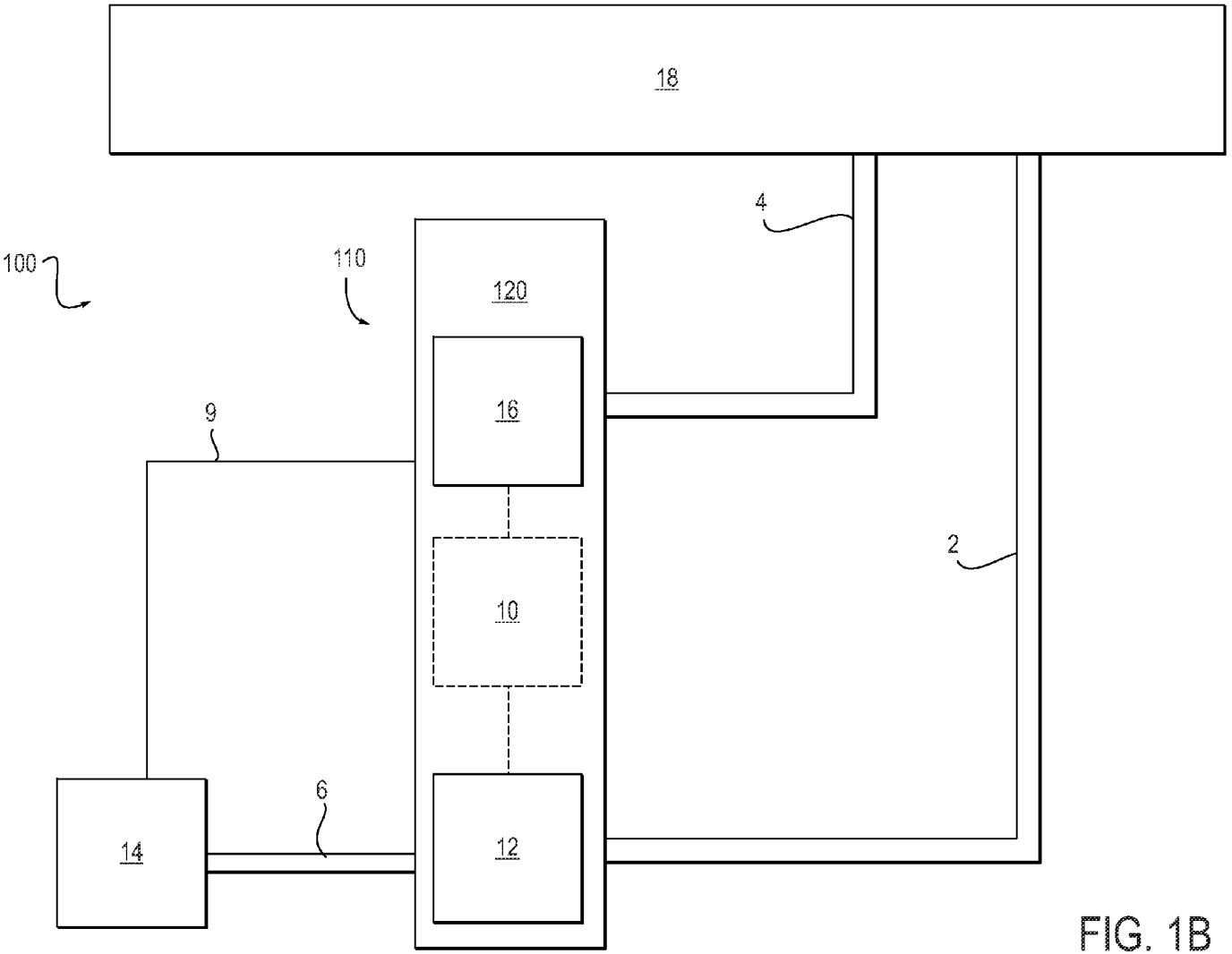
FIGS. 1B-C are schematic diagrams illustrating subsea installations according to two exemplary embodiments.

FIG. 1B is a schematic diagram illustrating one exemplary offshore hydrocarbon producing facility 100 according to the present disclosure. In this embodiment, a UTA 16 and a PLET 12 are each attached to a rigid support structure 120. The rigid support structure 120 and the components attached thereto are collectively referred to as an integrated termination assembly 110. The components, i.e., UTA 16 and PLET 12 as well as other optional components 10, may be permanently or temporarily mounted on the rigid support structure 120, or they may be encased by the rigid support structure 120. The integrated termination assembly components can also be mounting bases, receptacles or connectors designed to house equipment that can be installed and retrieved separately.

A first functional line, in this example a flowline 2, terminates at one end at the host facility 18 and at the other end at the integrated termination assembly 110. The flowline 2 is either directly connected to the PLET 12 or to a connection port on the integrated termination assembly 110, from which connection port internal plumbing is provided to connect to the PLET 12 within the integrated termination assembly 110. Similarly, a second functional line, in this example an umbilical 4, terminates at one end at the host facility 18 and at the other end either directly at the UTA 16 or to a connection port on the integrated termination assembly 110 which in turn is connected to the UTA 16, from which connection port internal plumbing is provided to connect to the optional components 10 within the integrated termination assembly 110. Since both the PLET 12 and the UTA 16 are part of the integrated termination assembly 110, when the integrated termination assembly 110 is deployed with the flowline 2 and the umbilical 4 connected thereto, the flowline 2 and the umbilical 4 are thereby also deployed. Once the integrated termination assembly 110 is deployed, connections can be made to tree 14. For instance, a jumper 6 can be used to connect to the PLET 12, either directly or via an internal connection between a connection port and PLET 12. Similarly, a flying lead 9 can be used to connect the tree 14 to the UTA 16, either directly or via an internal connection between a connection port and UTA 16.

The first functional line 2, the second functional line 4, or both lines 2 and 4, can optionally be disconnectable from the integrated termination assembly 110. This can be advantageous when the two functional lines are to be installed simultaneously, and later repositioned in the subsea environment.

As shown in FIG. 1B, the integrated termination assembly 110 can also include additional optional equipment 10, such as an optional pump, e.g. a multiphase booster pump, attached to the rigid support structure 120. Instead of or in addition to pumps, the equipment can also include one or more components including, but not limited to, compressors, separators, control modules, transformers, switchgear and combinations thereof. The integrated termination assembly 110 can be configured to provide a preinstalled power connection from the UTA 16 to the optional equipment 10, thus reducing the need for flying leads to be connected subsea. These connections can be made at the surface or onshore in a dry environment to enhance quality control during the makeup process by enabling increased testing prior to installation.

As represented throughout the present disclosure, the first and second functional lines represented by 2 and 4 can be any two differing functional lines, not limited to production flowlines or umbilicals, and the termination assemblies represented by 12 and 16 can be any corresponding termination structures or manifolds 13. For instance, other functional lines 2 and/or 4 which can be installed using the assembly and methods of the present disclosure include electrical cables, hydraulic fluid lines, chemical injection lines, fiber-optic cables, gas injection lines, water injection lines, pneumatic lines, and combinations thereof. Examples of functional lines which can be installed using the assembly and methods of the present disclosure include oil recovery gas lines, gas lift lines, well service lines, well kill lines, scale squeeze lines, methanol injection lines, lines for tertiary recovery (also referred to as enhanced oil recovery) fluid (e.g., carbon dioxide, nitrogen, air or oxygen, steam, formulations including polymers, gels, and the like), direct electrical heating lines, installation workover control system umbilicals, and combinations thereof.

In one embodiment, one of the functional lines can deliver power, control or both power and control to the equipment. The power, control or both power and control can be delivered to the equipment indirectly via a wet mateable connector or directly via a dry mateable connection. The integrated termination assembly provides a viable, cost effective solution for systems requiring dry mateable power connections for subsea boosting, which extend the water depth and power transmission capabilities.

The functional lines can take any convenient form, including, but not limited to, rigid pipe, unbonded flexible pipe, bonded flexible pipe, composite flexible pipe, composite material pipe, cables, hoses, umbilicals and combinations thereof.

It should be understood that additional functional lines and corresponding termination structures may be present.

Figure 1C:
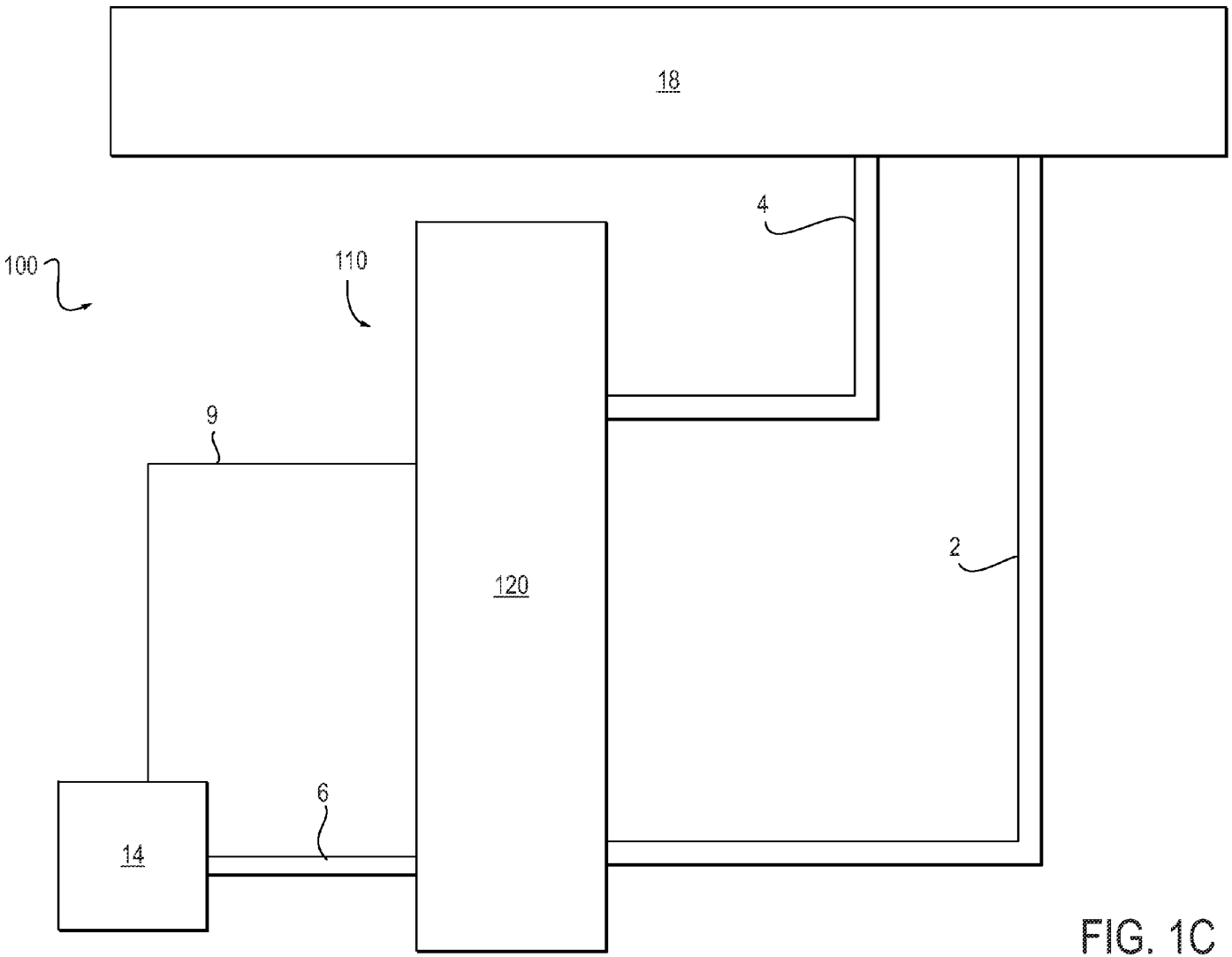

The termination components within the integrated termination assembly 110, e.g., UTA 16 and PLET 12 as well as other optional components indicated by reference numeral 10, may be discrete components within the integrated termination assembly 110 as illustrated in FIG. 1B, or their functionality may be shared or combined such that discrete components recognizable as a conventional UTA 16, a PLET 12 and/or other optional components indicated by reference numeral 10 are not found within the integrated termination assembly 110. This embodiment is illustrated in FIG. 1C.

The integrated termination assembly 110 can be configured to provide electrical and hydraulic connection from the UTA 16 to the PLET 12 or pipeline manifold 13, thus reducing the amount of flying leads 9 and jumpers 6 to be connected subsea. The integrated termination assembly 110 can also be configured to provide a tubular connection from a hydrate mitigation chemicals tube in the umbilical to the flowline to provide chemical injection capability to prevent hydrate formation, thus reducing the need for a looped flowline system. This tubular connection can be preinstalled and internal to the integrated termination assembly 110. Similarly, a tubular connection from a gas lift tube within the umbilical to the flowline can be provided.

Figure 2B:
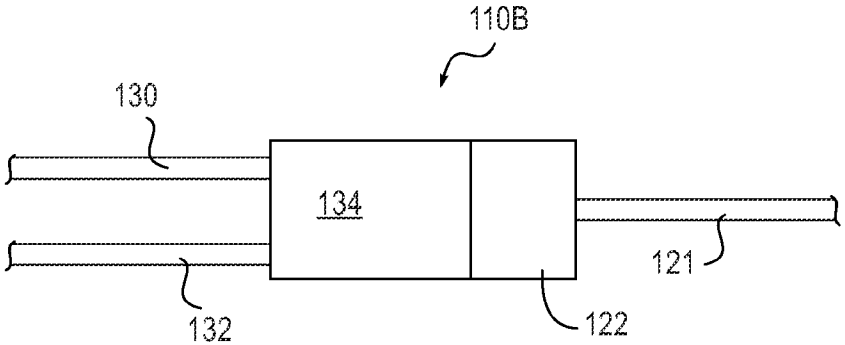
FIGS. 2A-D are schematic diagrams illustrating integrated termination assemblies according to alternative exemplary embodiments.
Figure 2D:
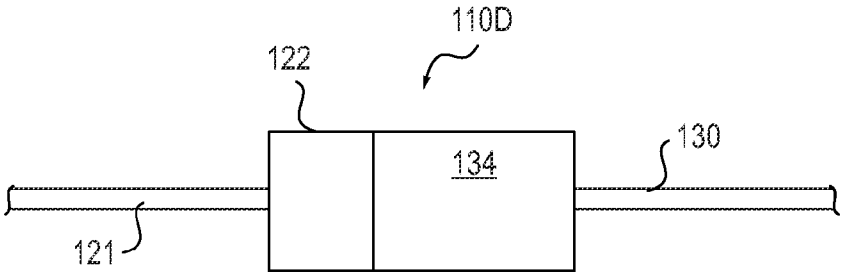
Figure 2A:
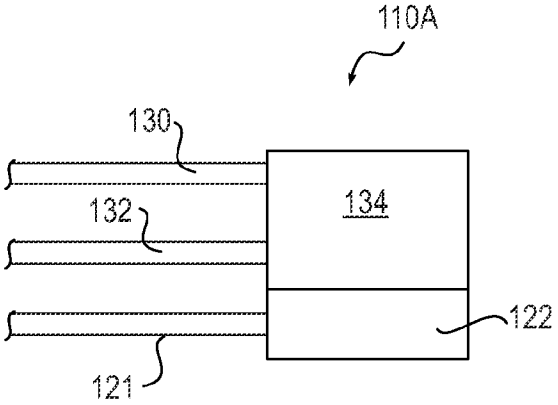
Figure 2C:
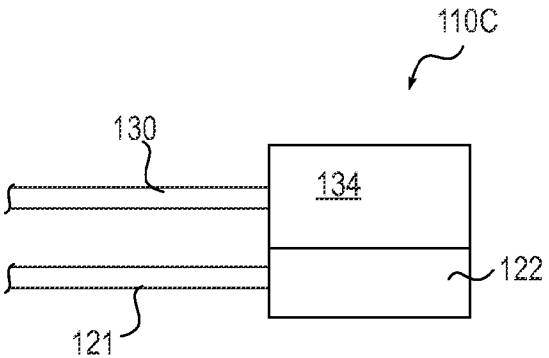

As shown in the examples illustrated by FIGS. 2A-D, the integrated termination assembly can have a number of different configurations. FIG. 2A illustrates an integrated termination assembly 110A useful for installing multiple functional lines of a first type, 130 and 132, and at least one functional line of a second type, 121. The two first functional lines 130 and 132 terminate at a first functional line termination structure 134. The second functional line 121 terminates at a second functional line termination structure 122 which is attached to the first functional line termination structure 134. FIG. 2C similarly illustrates an integrated termination assembly 110C useful for installing a single functional line of a first type, 130, and a functional line of a second type, 121. In both 110A and 110C, the different functional lines terminate at and extend from a common side of the rigid support structure of the integrated termination assembly, such that the at least one first functional line and the at least one second functional line are generally parallel with respect to each other. These configurations are herein referred to as "bundled," since during installation using these configurations, the different functional lines can be bundled. This allows concurrent installation of multiple functional lines.

The first functional line termination structure 134 and the second functional line termination structure 122 can be detachably and rigidly connected such that the first functional line and the second functional line can be deployed simultaneously. Alternatively, the first functional line termination and the second functional line termination can be permanently connected. Termination structures 122 and 134 can also be an integrated or combined functionality design such as item 120 in FIG. 1C.

FIG. 2B illustrates an integrated termination assembly 110B having a different configuration useful for installing multiple functional lines of a first type, 130 and 132, and at least one functional line of a second type, 121. The two first functional lines 130 and 132 terminate at a first functional line termination structure 134. The second functional line 121 terminates at a second functional line termination structure 122 which is attached to the first functional line termination structure 134. FIG. 2D similarly illustrates an integrated termination assembly 110D useful for installing a single functional line of a first type, 130, and a functional line of a second type, 121. In both 110B and 110D, the different functional lines terminate at and extend from opposite sides of the rigid support structure of the integrated termination assembly, such that the at least one first functional line and the at least one second functional line are generally in series with each other. These configurations are herein referred to as "in-line," since during installation using these configurations, the different functional lines are in line with respect to each other.

The first functional line termination structure 134 and the second functional line termination structure 122 can be detachably and rigidly connected such that the first functional line and the second functional line can be deployed simultaneously. Alternatively, the first functional line termination and the second functional line termination can be permanently connected. Termination structures 122 and 134 can also be an integrated or combined functionality design such as item 120 in FIG. 1C.

Figure 3A:
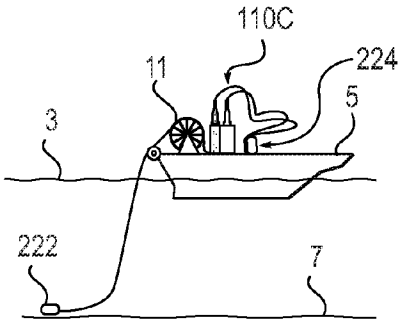
FIGS. 3A-E are illustrations of an installation method according to an exemplary embodiment.
Figure 3B:
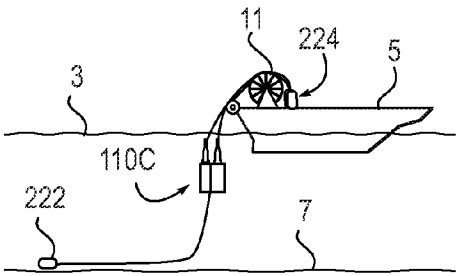
Figure 3C:
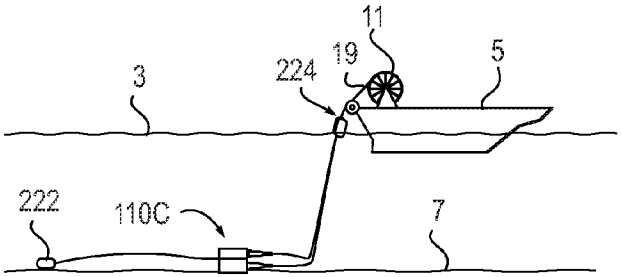
Figure 3D:
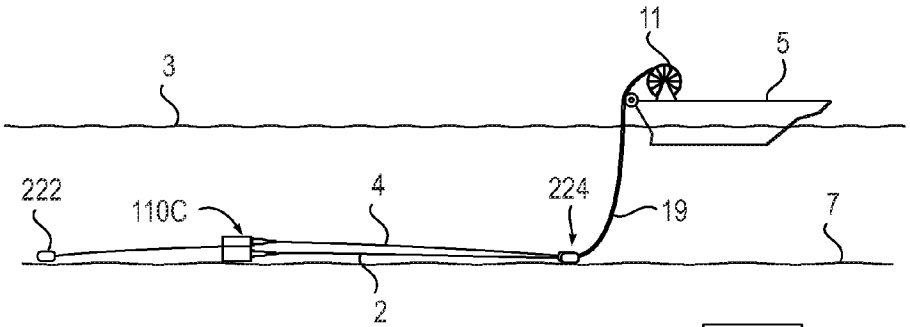
Figure 3E:
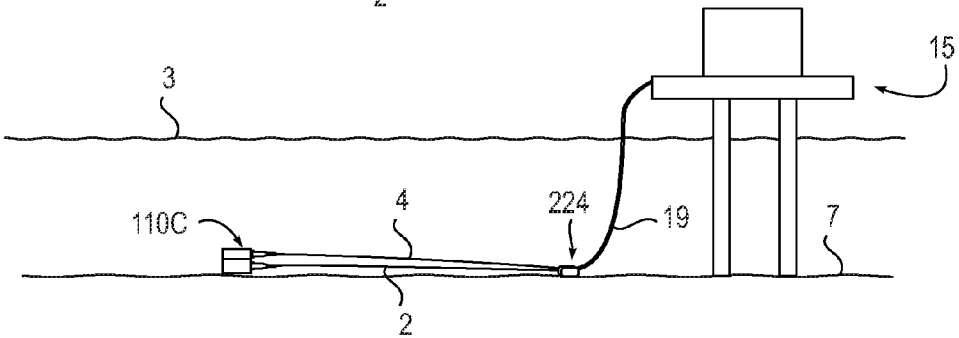

The installation method will depend on the integrated termination assembly configuration used. FIGS. 3A-E are stepwise illustrations of an installation method according to an exemplary embodiment in which an integrated termination assembly 110C having a bundled configuration is used. The integrated termination assembly 110C is initially loaded onto a surface vessel 5 in water 3. The assembly 110C is connected to the appropriate different functional lines to be installed, either onboard the vessel or onshore prior to loading on the vessel. In one embodiment, as shown in FIG. 3A, an anchor 222, or any other initiation aid as would be apparent to one skilled in the art, may be used to assist the initiation of the installation. As shown in FIG. 3B, the integrated termination assembly 110C is lowered to the seabed 7 at a desired location. FIGS. 3C and 3D are intermediate steps in a typical installation process. As shown in FIG. 3E, terminations 224 for connecting the different functional lines to the host facility 15 through risers 19 or to other subsea structures are provided at the ends of the functional lines. FIG. 3E shows the integrated termination assembly 110C and the associated first and second functional lines 4 and 2 in place in the desired location.

Figure 4A:
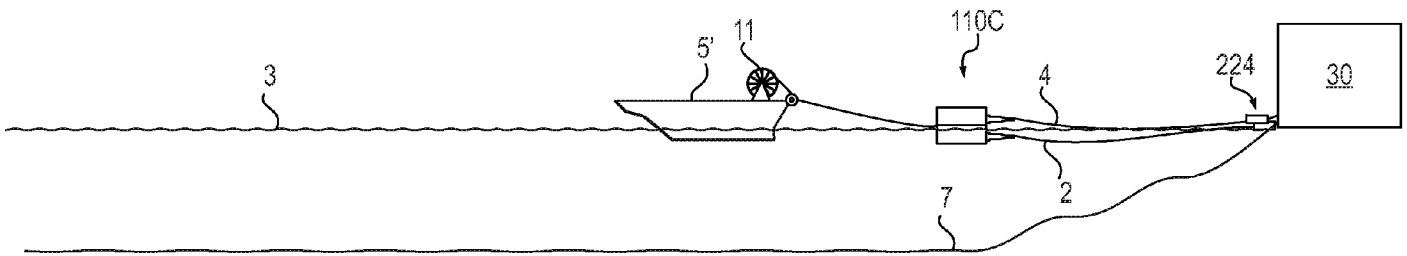
FIGS. 4A-C are illustrations of an installation method according to an alternative exemplary embodiment.
Figure 4B:
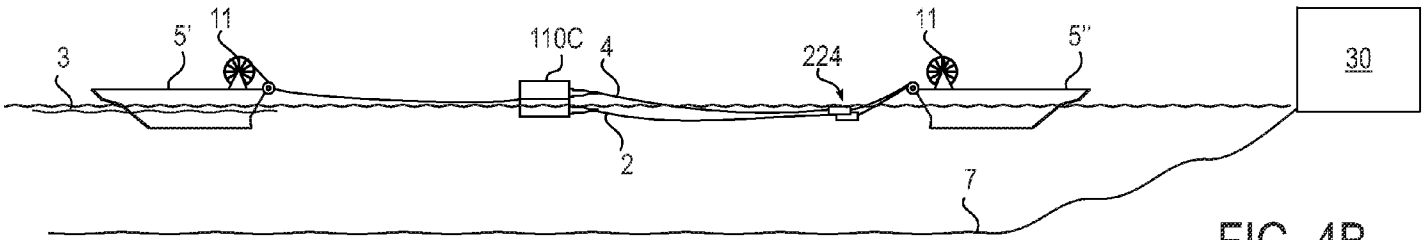
Figure 4C:
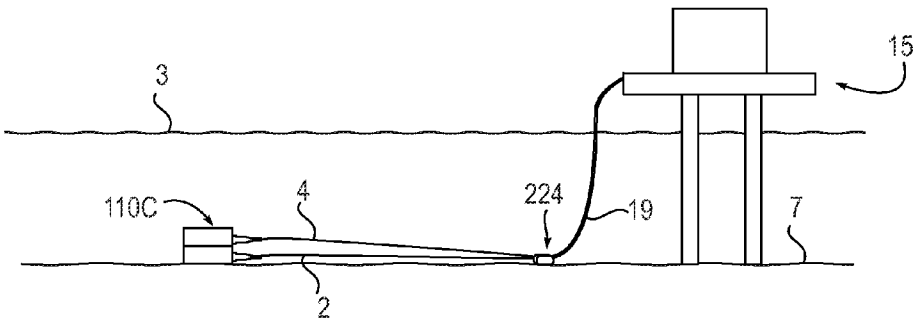

FIGS. 4A-C are illustrations of another installation method according to an alternative exemplary embodiment in which an integrated termination assembly 110C having a bundled configuration is used. In this embodiment, a towing vessel 5' tows the integrated termination assembly 110C from a base location 30 which can be onshore or on a floating facility such as a vessel or a barge, as shown in FIG. 4A. Towing aids such as buoyancy modules (not shown) may be applied to the lines and structures being towed as needed. Once the functional lines and terminations 224 have cleared the shoreline or the vessel, another towing vessel 5" assumes a position between the terminations 224 and the base location 30, and the connectors 224 are connected to the second towing vessel 5". In one embodiment, as shown in FIG. 4B, the two towing vessels 5' and 5" move away from base location 30 to a desired offshore location, and the integrated termination assembly 110C is lowered to the seabed 7. FIG. 4C illustrates the integrated termination assembly 110C on the seabed at the desired location after installation. In the embodiment shown, the functional lines are connected to an offshore platform 15 via connecting risers 19 connected to terminations 224. This method enables installation while avoiding the use of large expensive lay vessels.

Figure 5A:
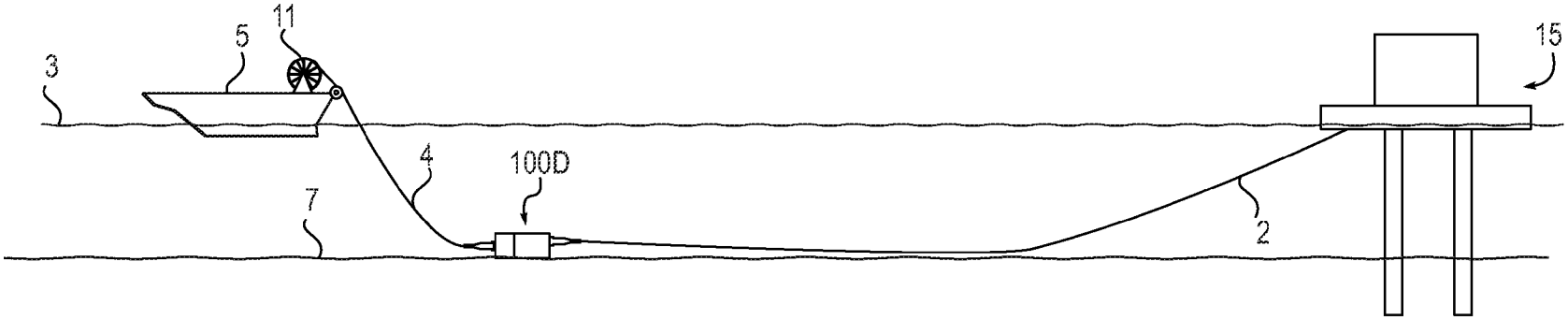
FIGS. 5A-B are illustrations of an installation method according to an alternative exemplary embodiment.
Figure 5B:
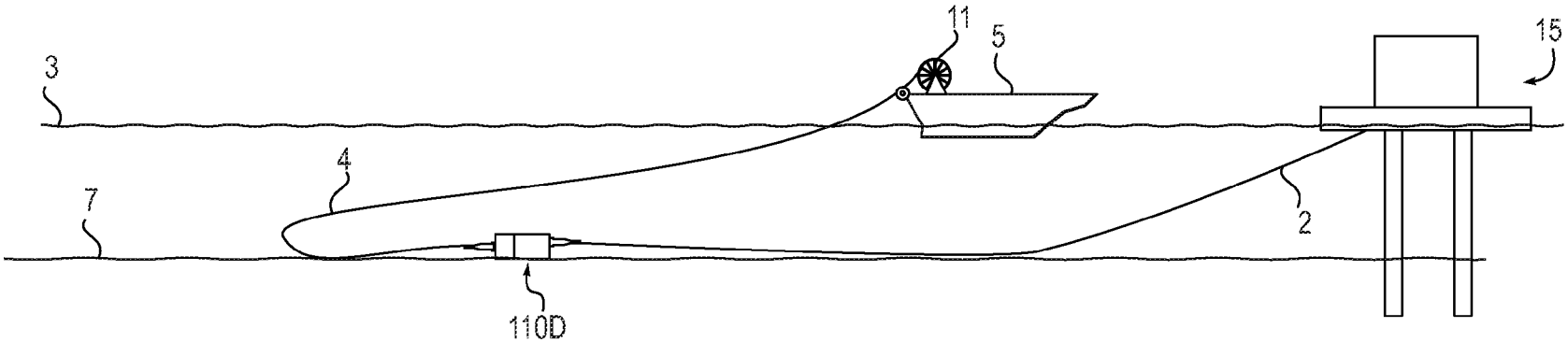

FIGS. 5A-B are illustrations of yet another installation method according to an alternative exemplary embodiment in which an integrated termination assembly 110D having an in-line configuration is used (similar to FIGS. 2B and 2D). As shown in FIG. 5A, a surface vessel 5 connects one of the functional lines to an offshore platform 15 or other subsea structures. The payout of the functional line is controlled from the surface vessel 5 and then the integrated termination assembly 110D is positioned at a desired seabed location. As shown in FIG. 5B, once the integrated termination assembly is placed in position, the vessel 5 continues the payout of the second functional lines back to the platform 15 or to another platform or subsea structure. This method enables continuous installation of multiple functional lines while the vessel is moving, avoiding interruptions in the vessel operations. By virtue of the fact that installation is continuous, there are fewer connections and installation time, safety and cost are improved.

The integrated termination assembly in combination with associated functional lines can advantageously be utilized as a re-deployable package that facilitates installation and recovery of the functional lines and integrated termination assembly for various temporary or nonpermanent applications such as early production systems, pre-commissioning and commissioning activities, repairs, maintenance, workovers, interventions, production system decommissioning, testing and the like. The use of the integrated termination assembly in combination with associated functional lines can provide a low cost flexible solution for marginal developments, facilities phased extensions, early production facilities or extended well tests. It can furthermore be modularized for interface with a standard production facility (e.g., a floating production, storage and offloading vessel (FPSO), floating production unit (FPU) or a tieback to an existing production platform) for quick deployment and implementation.

Example

A comparison was made of installation times required to install a subsea production system including a separate PLET and UTA using a conventional installation method (Comparative Example) and a subsea production system installed using an integrated termination assembly according to the present disclosure.

For the Comparative Example, a subsea hydrocarbon production field as shown in FIG. 1A is assumed, including an umbilical 4 extending from a host facility 18 and terminating at a UTA 16. The UTA 16 is connected to a single tree 14 as well as a PLET 12 by flying leads 9. A flowline 2 extends from a host facility 18 and terminates at a PLET 12. The PLET 12 is connected by a jumper 6 to the tree 14.

For the Example of the invention, a subsea hydrocarbon production field as shown in FIG. 5B is assumed. The in-line configuration of the integrated termination assembly 110D is assumed, having one flowline 2 and one umbilical 4 connected thereto. The integrated termination assembly 110D is connected to a single tree (not shown) by flying leads and a jumper (not shown).

Assuming that both installations are conducted from a similar size vessel having equivalent spread rate, estimates of the installation time for the Comparative Example and the Example of the invention are given in the following Table.

| | Installation time (days) | |
|---|---|---|
| Equipment | Comparative Example | Example of the invention |
| Umbilical | 1.5 | 1 |
| Flexible | 1.5 | 1 |
| UTA Mudmat | 0.5 | 0 |
| PLET | 0.5 | 0 |
| integrated termination assembly | 0 | 0.5 |
| Jumper | 3 | 3 |
| Flying Leads | 3 | 1 |
| Survey | 2 | 1 |
| Total | 12 | 7.5 |

Based on the estimates in the Table, the system using the integrated termination assembly can potentially save about 37.5% of offshore system installation time. These benefits can be even greater when the bundled configuration as illustrated in FIG. 2A or 2C is used.

Where permitted, all publications, patents and patent applications cited in this application are herein incorporated by reference in their entirety, to the extent such disclosure is not inconsistent with the present invention.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description, those skilled in the art will perceive improvements, changes and modifications, which are intended to be covered by the appended claims.

What is claimed is:

1. An integrated termination assembly comprising:

a. a rigid support structure comprising:

i. a first functional line termination structure; and ii. a second functional line termination structure detachably and rigidly connected to the first functional line termination structure;

b. at least one first functional line terminating at the first functional line termination structure of the rigid support structure; and c. at least one second functional line having a different function than the at least one first functional line terminating at the second functional line termination structure of the rigid support structure;

wherein the at least one first functional line and the at least one second functional line are each selected from the group consisting of production flow lines, electrical cables, hydraulic fluid lines, chemical injection lines, fiber-optic cables, gas injection lines, water injection lines, pneumatic lines, and combinations thereof.

2. The integrated termination assembly of claim 1, wherein the at least one first functional line and the at least one second functional line are disconnectable from the rigid support structure.

3. The integrated termination assembly of claim 1, wherein one of the at least one first functional line and the at least one second functional line is selected from the group consisting of oil recovery gas lines, gas lift lines, well service lines, well kill lines, scale squeeze lines, methanol injection lines, tertiary recovery fluid lines, direct electrical heating lines, installation workover control system umbilicals, and combinations thereof.

4. The integrated termination assembly of claim 1, wherein the at least one first functional line and the at least one second functional line are each selected from the group consisting of rigid pipe, unbonded flexible pipe, bonded flexible pipe, composite flexible pipe, cables, hoses, and umbilicals and combinations thereof.

5. The integrated termination assembly of claim 1, wherein the at least one first functional line and the at least one second functional line terminate at and extend from a common side of the rigid support structure such that the at least one first functional line and the at least one second functional line are generally parallel with respect to each other.

6. The integrated termination assembly of claim 1, wherein the at least one first functional line and the at least one second functional line terminate at and extend from opposite sides of the rigid support structure such that the at least one first functional line and the at least one second functional line are generally in series with each other.

7. The integrated termination assembly of claim 1, further comprising equipment attached to the rigid support structure wherein the equipment is selected from the group consisting of pumps, compressors, separators, control modules, transformers, switchgear and combinations thereof.

8. The integrated termination assembly of claim 7, wherein one of the at least one first functional line and the at least one second functional line delivers one of power, control or both power and control to the equipment.

9. The integrated termination assembly of claim 8, wherein the power, control or both power and control is delivered to the equipment indirectly via a wet mateable connector or directly via a dry mateable connection.

10. A method for installing at least one first subsea functional line and at least one second subsea functional line, comprising:

operating a surface vessel carrying an integrated termination assembly from a first location to a second location, the integrated termination assembly comprising:

a. a rigid support structure comprising:

i. a first functional line termination structure; and ii. a second functional line termination structure connected to the first functional line termination structure;

b. at least one first functional line terminating at the first functional line termination structure of the rigid support structure; and c. at least one second functional line having a different function than the at least one first functional line terminating at the second functional line termination structure of the rigid support structure;

lowering from the surface vessel to a predetermined seabed location the integrated termination assembly such that the integrated termination assembly, the at least one first functional line and the at least one second functional line are installed on the seabed.

11. The method of claim 10, wherein the integrated termination assembly is lowered from the surface vessel by means of a winch wire suspended from a crane.

12. The method of claim 10, wherein the integrated termination assembly having buoyancy modules attached thereto is lowered from the surface vessel.

13. The method of claim 10, further comprising disconnecting the first and second functional line termination structures after installation of the integrated termination assembly on the seabed.

14. A method for installing at least one first subsea functional line and at least one second subsea functional line, comprising:

a. towing an integrated termination assembly from a base location to a first offshore location by a first surface vessel, the integrated termination assembly comprising:
   i. a rigid support structure comprising:
      1. a first functional line termination structure; and
      2. a second functional line termination structure connected to the first functional line termination structure;
   ii. at least one first functional line terminating at the first functional line termination structure of the rigid support structure; and
   iii. at least one second functional line having a different function than the at least one first functional line terminating at the second functional line termination structure of the rigid support structure;
   wherein the first subsea functional line and the second subsea functional line terminate at and extend from a common side of the rigid support structure such that the first subsea functional line and the second subsea functional line are generally parallel with respect to each other;

b. connecting the first subsea functional line and the second subsea functional line to a second surface vessel;

c. towing the integrated termination assembly by the first surface vessel and the second surface vessel to a desired offshore location; and d. lowering the integrated termination assembly onto the seabed such that the integrated termination assembly, the first functional line and the second functional line are installed on the seabed.

15. A method for installing at least one first subsea functional line and at least one second subsea functional line, comprising:

operating a surface vessel so that the surface vessel moves in a first direction while lowering to a predetermined seabed location an integrated termination assembly comprising:

a. a rigid support structure comprising:
   i. a first functional line termination structure; and
   ii. a second functional line termination structure connected to the first functional line termination structure;

b. at least one first functional line terminating at the first functional line termination structure of the rigid support structure; and c. at least one second functional line having a different function than the at least one first functional line terminating at the second functional line termination structure of the rigid support structure;

while operating the surface vessel, lowering from the surface vessel the integrated termination assembly and one of the at least one first functional line and the at least one second functional line thereby installing the at least one first functional line and the at least one second functional line;

upon lowering the integrated termination assembly and installing the at least one first functional line and the at least one second functional line, operating the surface vessel so that the surface vessel moves in a direction generally opposite to the first direction and simultaneously installing on the seabed the other of the at least one first functional line and the at least one second functional line.

16. The method of claim 14 or claim 15, wherein at least one of the first subsea functional line and the second subsea functional line is selected from the group consisting of production flow lines, electrical cables, hydraulic fluid lines, chemical injection lines, fiber-optic cables, gas injection lines, water injection lines, pneumatic lines, and combinations thereof.

17. The method of claim 14 or claim 15, wherein at least one of the first subsea functional line and the second subsea functional line is a production flow line.

* * * * *